US008978677B2

(12) United States Patent
Roberts

(10) Patent No.: US 8,978,677 B2
(45) Date of Patent: Mar. 17, 2015

(54) MULTI-FUNCTIONAL WALKING AID

(71) Applicant: Ronald Roberts, Lafayette, CO (US)

(72) Inventor: Ronald Roberts, Lafayette, CO (US)

( * ) Notice: Subject to any disclaimer, the term of this patent is extended or adjusted under 35 U.S.C. 154(b) by 120 days.

(21) Appl. No.: 13/780,411

(22) Filed: Feb. 28, 2013

(65) Prior Publication Data

US 2014/0240963 A1 Aug. 28, 2014

(51) Int. Cl.
*A45B 3/02* (2006.01)
*A45B 3/00* (2006.01)
*A61H 3/02* (2006.01)

(52) U.S. Cl.
CPC ... *A45B 3/00* (2013.01); *A45B 3/02* (2013.01); *A61H 2003/0222* (2013.01)
USPC ..... 135/66; 135/70; 294/104

(58) Field of Classification Search
CPC ..... A61H 3/02; A61H 2003/0222; A45B 3/00
USPC ..... 135/65–66, 69–70, 72, 80–81, 84, 911; 294/19.1, 19.3, 104–105, 115, 192, 294/209–210; 248/155, 188.9; 223/118–119
See application file for complete search history.

(56) References Cited

U.S. PATENT DOCUMENTS

| | | | | | |
|---|---|---|---|---|---|
| 465,222 | A | * | 12/1891 | Ulbricht | 294/104 |
| 2,445,942 | A | * | 7/1948 | Dusinberre | 135/85 |
| 2,861,835 | A | | 11/1958 | Smith | |
| 3,093,402 | A | * | 6/1963 | Sisson | 294/100 |
| 3,467,116 | A | | 9/1969 | Ringewaldt | |
| 4,056,278 | A | * | 11/1977 | Bau et al. | 294/1.4 |
| 4,794,743 | A | * | 1/1989 | Lehneis | 135/65 |
| 4,811,750 | A | | 3/1989 | McAllister | |
| 4,827,956 | A | | 5/1989 | Toot | |
| 5,036,873 | A | * | 8/1991 | Clayton | 135/69 |
| 5,176,160 | A | | 1/1993 | Osborn | |
| 5,392,800 | A | | 2/1995 | Sergi | |
| 5,433,234 | A | | 7/1995 | Lapere | |
| 5,590,923 | A | * | 1/1997 | Berger et al. | 294/116 |
| 5,636,650 | A | | 6/1997 | Kroeze | |
| 5,640,985 | A | | 6/1997 | Snyder | |
| 6,386,216 | B1 | * | 5/2002 | Cubelli | 135/66 |
| 6,513,844 | B1 | * | 2/2003 | Hsu | 294/210 |
| 6,550,490 | B1 | | 4/2003 | Morton et al. | |
| 7,243,668 | B1 | | 7/2007 | Kroeze | |
| 7,624,746 | B2 | | 12/2009 | Blake | |
| D632,069 | S | | 2/2011 | Thiessens | |
| 7,934,756 | B2 | * | 5/2011 | Kroeze | 294/210 |
| 8,122,900 | B1 | | 2/2012 | Hayes et al. | |
| 2004/0040588 | A1 | | 3/2004 | Parigian | |
| 2004/0255995 | A1 | | 12/2004 | Garrett | |
| 2006/0266397 | A1 | * | 11/2006 | Berl | 135/70 |

FOREIGN PATENT DOCUMENTS

EP 1707067 A1 10/2006

* cited by examiner

*Primary Examiner* — Winnie Yip
(74) *Attorney, Agent, or Firm* — John A. Arsenault; Daniel M. Dubuisson

(57) ABSTRACT

An improved cane with an internal grasping apparatus including an actuator on the cane handle and a plurality of clamps that extends from the foot or base of the cane. A cord system within the casing of the cane connects the actuator to the clamps so that when the actuator is in use, the clamps close or open to either grasp or release objects, depending on the amount of pressure applied to the actuator. Applying pressure to the actuator extends a plurality of clamps from the distal end of the cane that can be used to assist with grasping of objects. Releasing pressure to the actuator on the cane handle will retract the clamps back into the distal end of the cane to where the clamps are hidden.

7 Claims, 8 Drawing Sheets

MULTI-FUNCTIONAL WALKING AID

STATEMENT REGARDING FEDERALLY SPONSORED RESEARCH AND DEVELOPMENT

Not Applicable.

FIELD OF THE INVENTION

This invention relates to improvements in internally housed grasping assemblies and/or assisted walking apparatuses for individuals with disabilities or as a tool for those in need of physical assistance during the rehabilitation process.

DISCUSSION OF RELATED ART

Individuals needing physical assistance often rely on walking canes or other tools to help them accomplish movement from one place to another and the grasping of objects and items that are out of a comfortable reach. Canes are necessary to avoid extensive flexing of the legs, hip, torso, or other areas during gait. Reaching devices are necessary to prevent strain on areas of the body where a user is experiencing pain or physical discomfort. Moreover, grasping and reaching devices are useful to also avoid extensive flexing of certain muscles including the legs, hip, torso, arms, or other areas of the body. When an individual is recovering from an intensive surgery such as hip surgery or knee surgery they often require both a walking cane and reaching device to assist them. Use of multiple bulky devices during the recovery process that are difficult to transport can be highly inconvenient and can reduce mobility.

In order to resolve the problems associated with requiring physical assistance, mechanical devices have been developed to assist those who need help reaching and/or grasping items while minimally stressing certain muscle groups. In most cases, these items comprise a shaft, a handle with a actuator to extend or retract an externally placed grasping device with fingers located at the distal end of the cane shaft, and a plurality of fingers or clamps, used to grasp items when the user applies pressure to the actuator mechanism. Because the actuator and clamp components are interconnected, the clamps open or close based on the pressure applied to the actuator by the user when reaching for objects. However, these mechanical devices are not useful for tasks such as walking because they are intended for grabbing items. For those in need, carrying multiple devices to assist them with the daily functions of life is inconvenient and burdensome.

Some devices have attempted to combine a walking aid device and grasping device with unsatisfactory results. These combinations are not only complex to manufacture, but are also challenging for users to operate efficiently, and they are prone to breakage. In Elmore, U.S. Pat. No. 3,591,226, a gripping device is disclosed with a shoehorn placed at the distal end of the device to assist with fitting into a shoe. The gripping device is activated through a trigger or actuator and a cable housed internally that attaches to an externally placed grasping arm. The shoehorn component also assists with the effectiveness of the grasping components by acting as a base. This device however is not intended to provide assistance while walking, but rather it is a device used to assist with grasping items that are out of reach.

Placement of the mechanical functionality and grasping components external to the shaft increases the likelihood that one of those components could be damaged during regular use. It would be an improvement to find a way to internally house the grasping components and any cabling between the grasping components and actuator within the shaft of the cane without reducing the ability to support an individual during gait.

Multi-functional grabbing devices frequently place the grasping mechanics on the periphery of the device, increasing the likelihood that some components will break, reducing the overall functionality of the device. See Snyder, U.S. Pat. No. 5,640,985, Lapere, U.S. Pat. No. 5,433,234, Morton et al., U.S. Pat. No. 6,550,490, and Blake, U.S. Pat. No. 7,624,746.

Moreover, external placement of the grasping components can undermine the structural integrity of a cane device, making it more likely that an individual will have an accident because there are more areas for an object to become attached and stuck to the cane or grabber components during use as a walking aid. Placement of grasping components around the periphery of the walking aid can result in an increased risk of falling or tearing of an object caught up in the grasping components.

Unlike devices in the prior art, placement of the grasping components internal to the shaft reduces the likelihood that the grasping assembly will become damaged during regular use. Partially internal grasping components on walking assistance devices in the prior art are intended for specific tasks such as picking up golf balls and are not perfected for more general use. Berkowitz, U.S. Pat. No. 5,707,303. The present invention increases the ability of a user to pick up out of reach objects generally using the internally placed grasping members. The present invention also allows a user to conceal and lock or activate the internally placed grasping members at their convenience.

Thus, there is a need for a multifunctional safe and convenient retractable concealed grasping apparatus that can also be used to assist with walking, and other added functions that overcomes the present limitations of devices in the prior art. The present invention accomplishes this and several other goals.

SUMMARY OF THE INVENTION

The goal and object of the present invention is to provide an improved internally housed grasping assembly that can be accessed via an actuator on the handle of the device.

In the primary embodiment of the present invention, the shaft is hollowed out with a bore throughout. A flexible elongated connecting component with ends, such as a cable, is secured to an actuator component near the proximal end of the shaft and one or more grasping members at the distal end. When in an "open" configuration, applying grasping pressure to the actuator pulls the grasping members toward one another and creates a "grip" that can be used to reach objects that may be difficult for the user.

The present device is intended to be simple as well as inexpensive to manufacture and assemble. Based on the design by the inventor for the present device, the invention is also intended to provide a simplified device for accomplishing the tasks of assistance with gait and improved reaching and grasping capabilities for out of reach objects.

Another object of the present invention is to provide a multi-functional grasping assistance device that can also support the body weight of an individual to improve safety.

It is another object of the present invention to provide an apparatus that reduces physical stress on the hips and knees of a user when having to bend over or reach to pick up objects.

Finally, it is an object of the present invention to disclose a reaching device that is symmetrical along a longitudinal axis passing through a shaft component.

Embodiments will include one, more, or any combination of all of the features listed above.

Other features and advantages of the present invention will become apparent from the following more detailed description, taken in conjunction with the accompanying drawings and illustrations, which illustrate, by way of example, the principles of the invention.

DETAILED DESCRIPTION OF THE PREFERRED EMBODIMENT

Illustrative embodiments of the invention are described below in the accompanying Figures. The following detailed description provides detailed schematics for a thorough understanding of and an enabling description for these embodiments. One having ordinary skill in the art will understand that the invention may be practiced without certain details. In other instances, well-known structures and functions have not been shown or described in detail to avoid unnecessarily obscuring the description of the embodiments.

Figure 1:
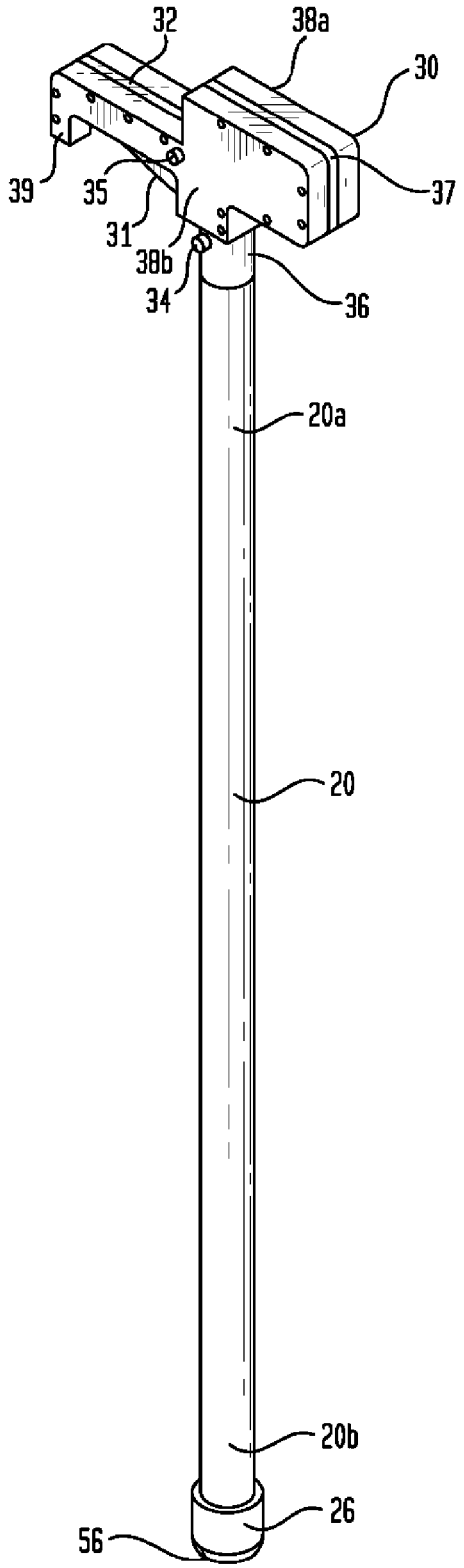
FIG. 1 is a perspective view of a multi-functional walking device in the closed configuration.
Figure 2:
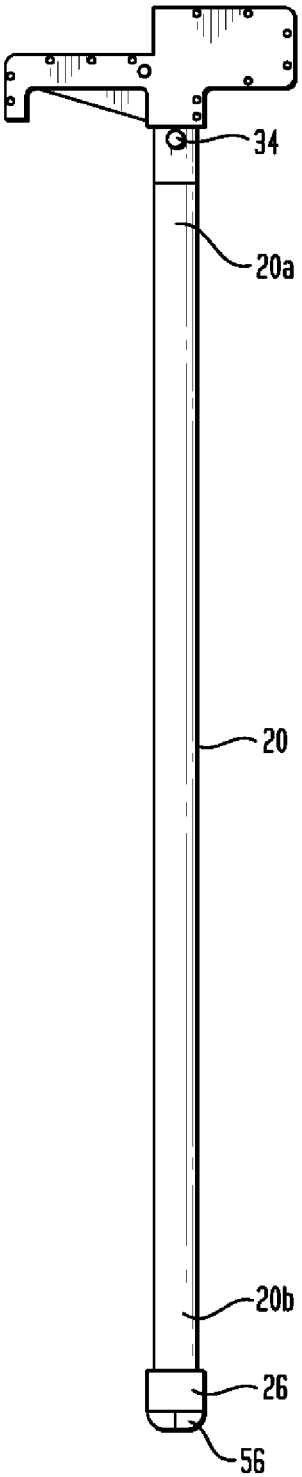
FIG. 2 is a perspective view of the multi-functional walking device of FIG. 1 in the open configuration.

In FIGS. 1-2, a preferred multi-functional walking device assembly features an upright elongated, tubular, hollow shaft component 20 having proximal and distal ends 20*a* and 20*b* respectively. The cane handle 30 is mounted to the shaft 20 via external threading 21 on the proximal end 20*a* of the shaft and a threaded port 36 at the bottom of the handle 30 and a safety screw 34 fastening the shaft to the handle. The cane handle 30 includes an actuator 31, a grabbing area 32 for the user's hand, a locking pin 35, and a hanging tip 39. The lower distal part of the cane as shown in FIG. 1 includes a cylindrical ferrule 26 placed concentrically around the distal end of the shaft 20(*b*) and the circular ferrule pads 56.

The cane handle 30 is contemplated to be one or more surfaces arranged perpendicular to the shaft 20 curved into an inverted J shape that may be curved or straight that also includes a base that connects the handle to the proximal end of the shaft 20. In one embodiment the handle 30 is separated longitudinally into two symmetrical handle components 38*a* and 38*b* wherein the actuator 31 is placed between the two handle components 38*a* and 38*b*.

The handle 30 is designed so that it can be held or grasped by an individual hand for use as a cane or a grabbing device. One or more center components 37 are used to provide continuity across the surface of the handle 30 based on the additional elements that contribute to the improved functionality. The center component 37 is placed between the symmetrically arranged handle components 38*a* and 38*b* and fastened together via one or more fastening means such as one or more screws, bolts, pins, or other articles used to fasten items together at multiple points. When placed together with the center component 37, the symmetrically arranged handle components 38*a* and 38*b* also form a base section that includes a port to receive the shaft 20 that attaches via internal threading 36 placed on the ventral side of the handle 30. The proximal end 20*a* of the shaft 20 features external threading 21 designed to interface with the internal threading 36 of the handle 30 and secure the handle 30 to the shaft 20.

The actuator 31 is designed so that in the open configuration, when upward force is applied it moves from a released resting point furthest away from the handle 30 to an actuating point closest to the handle 30. The actuator 31 is located along the dorsal side of the grabbing area 32 near the base of the handle 30 so that a user can grip the actuator 31 and pull it inwards to activate the grabbing functionality.

When the device is in use and the shaft 20 is further away from the user's limbs, the hanging tip 39 is located at the posterior end of the grabbing area 32 of the handle 30. The hanging tip 39 allows a user to hang the device from one or more planar surface edges, such as a counter-top or a desk. Once the device is suspended from a surface via the hanging tip 39, the resting of the hanging tip 39 prevents the invention from dislodgment from a surface.

The device handle 30 also includes the locking pin 35 that restricts or permits movement of the actuator 31 by securing or unsecuring the locking pin 35. The locking pin 35 is in the closed configuration when pressed fully toward the handle 30. The locking pin 35 prevents the user from applying pressure to the actuator 31 when moved toward the handle 30. When the locking pin 35 is in the closed configuration, the actuator 31 cannot be activated and the grasping functionality of the cane is not available because the locking pin prevents upward movement of the actuator when upward pressure is applied.

When placing the locking pin 35 in the open configuration, the full grasping functionality is available to a user via the actuator 31 because the unlocking of the locking pin 35 frees up the the actuator 31 so it can move upward or downward. A user can place the walking device into the open configuration by pressing the locking pin 35 away from the handle 30. If the locking pin 35 is placed into the open configuration, the user can grasp one or more items via the grasping members 51 located at the distal end 20*b* of the shaft 20 by applying upward force on the actuator 31 toward the handle 30. The internally placed cable 41 has additional flexibility when the locking pin 35 is in the open configuration, which allows a user to pull the grasping members 51 inward toward the shaft 20 to create the grasping functionality. To maintain an object within the grasping members 51 a user should apply a continuous amount of pressure to the actuator 31. If a user disengages pressure from the actuator 31, the grasping members 51 will automatically move outward and away from one another, reducing the grip on an object.

Figure 3:
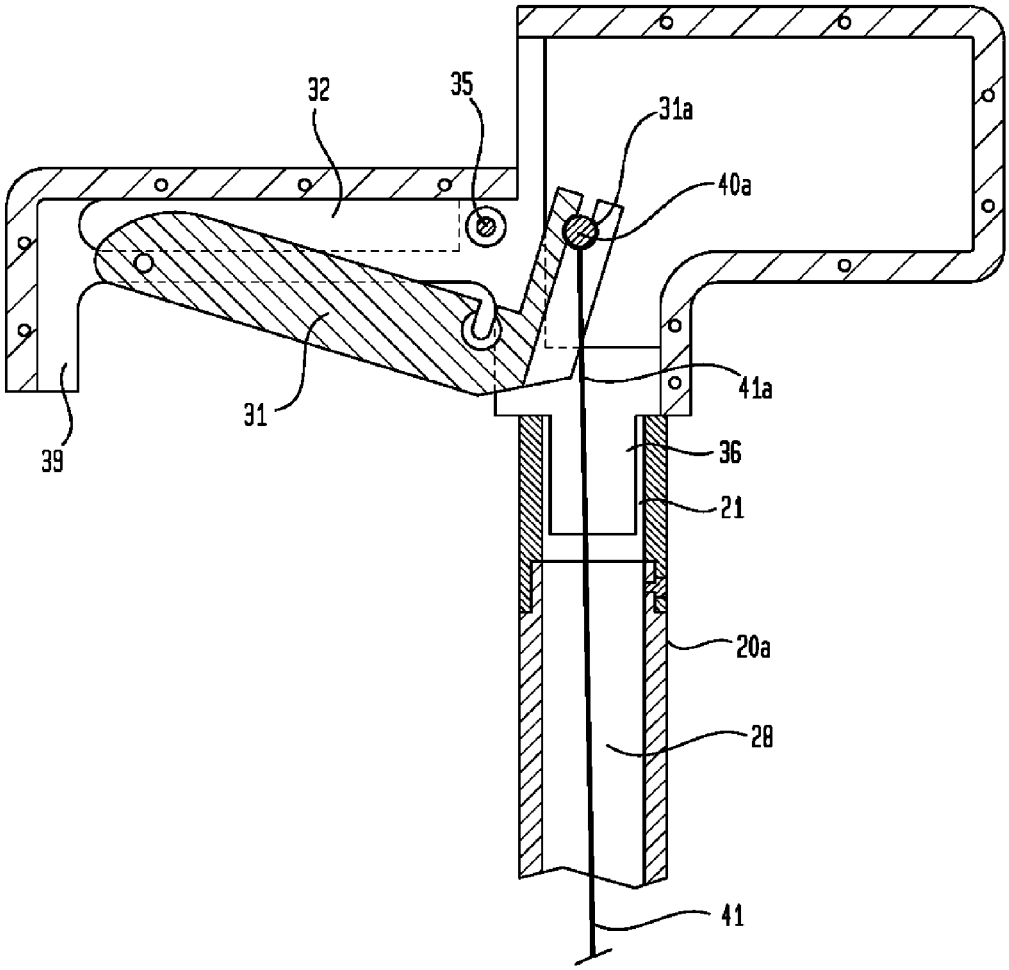
FIG. 3 is an internal view of the inner handle and upper shaft of the multi-functional walking device of FIG. 1 in the open configuration.
Figure 4:
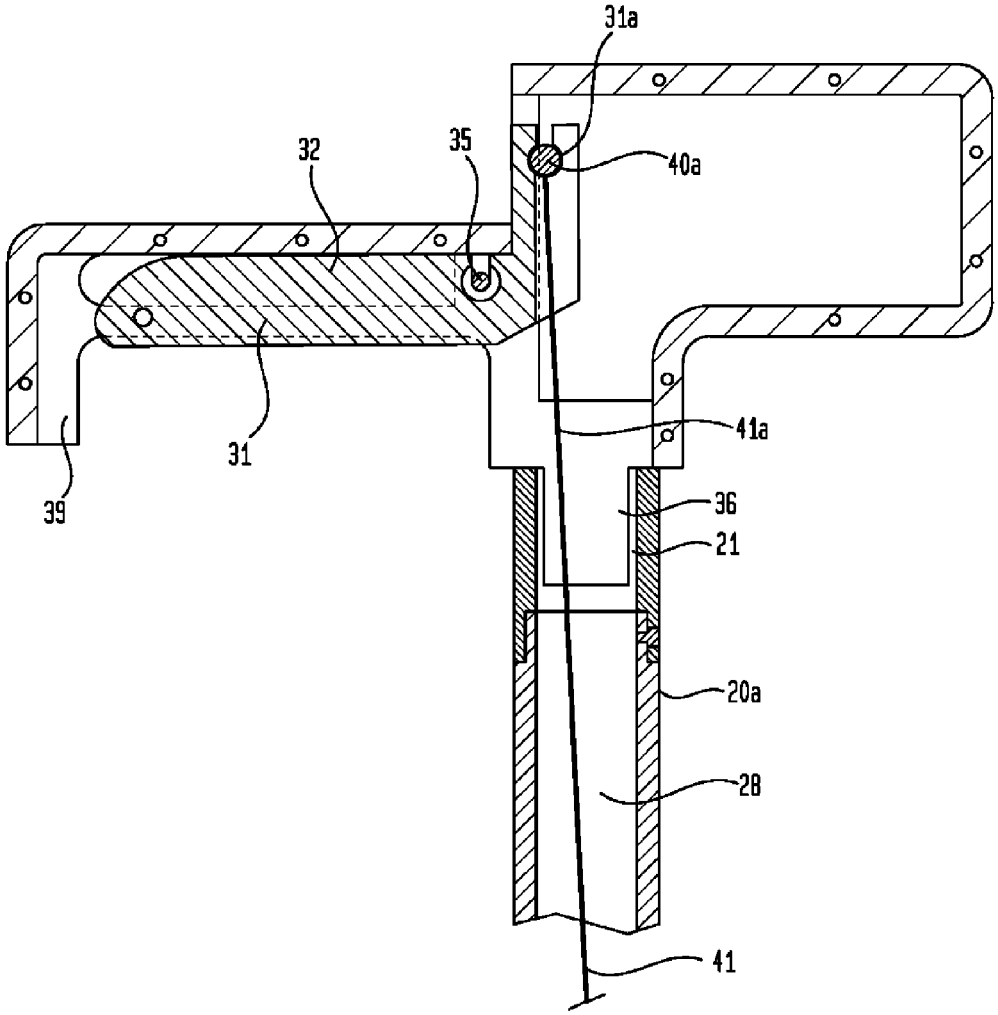
FIG. 4 is an internal view of the inner handle and upper shaft of the multi-functional walking device of FIG. 1 in the closed configuration.

FIG. 3 is an internal profile view of the upper portion of the device of FIG. 1 in the open configuration and FIG. 4 is an internal profile view of the upper portion of the walking device of FIG. 1 in the closed configuration. In both FIGS. 3-4, the shaft 20 and cable 41 are shown as broken away to indicate that no particular length is being claimed. Also in both Figures, the elongated hollow inner shaft 28 houses the linkage assembly 40, which enables the grasping functionality and runs the length of the shaft 20 connecting to the actuator 31 to the distal end of the shaft 20*b*. The proximal end of the shaft 20*a* as shown in FIGS. 3-4 include external threading 21 designed to interface to the handle 30 via internal threading 36 located on the bottom of the handle 30.

The internal portion of the actuator 31 also includes an opening 31*a* that secures the proximal end 41*a* of the cable to the actuator 31. Once a user applies force to the actuator 31 with the cable 41 attached to the actuator opening 31*a*, the actuator 31 lifts the linkage assembly 40 upward via the cable 41. The resulting convergence of the connected grasping members 51 creates a "grip" around an object and the object as the grasping members 51 are pulled upward into the shaft 20.

To secure the walking device into the closed configuration from the open configuration, a user must fully engage the actuator 31 and then push the locking pin 35 toward the handle 30. Once in the closed configuration, the grasping members 51 will not mechanically protrude outward from the shaft 20 and will remain internal to the hollowed portion 28. The device will resemble a traditional walking aid in the closed configuration. The locking pin 35 will not move into the closed configuration unless the actuator 31 is fully engaged. When in the closed configuration, the actuator 31 will not engage at all until the locking pin 35 has been unsecured.

The linkage assembly 40 of the present invention facilitates and transmits the motion of the actuator component to the grasping member housing 50. The linkage assembly 40 includes a proximal ball-shaped element 40*a*, attached at the proximal end 41*a* of the cable 41 that connects to a port 31*a* in the actuator 31 and a distal ball-shaped element 40*b*, attached at the distal end 41*b* that fastens to the grasping member housing 50. The cable 41 is placed within the internal hollow portion 28 of the cane shaft 20 from the proximal end 20*a* to the distal end 20*b*. The opening 31*a* on the actuator 31 attaches to the proximal end 41*a* of the cable 41, while the distal end 41*b* attaches to a holder 42 that is part of the grasping member housing 50.

The inventor contemplates any number of materials to construct the cable 41. Various materials contemplated by the inventor include coated or uncoated metals that provide durability and resistance such as stainless steel or aluminum. Advantageously, a non-elastic material would be exemplary as a cable 41 so that stretching and compression is minimized. By reducing or eliminating stretching and compression, the force applied by the user to the actuator 31 directly relates to the grasping force that is transferred to the grasping members 51.

It is conceived that the handle 30 can be interchangeable via the internal threading 36 located at the bottom of the handle 30 so that the internal grasping assembly can be used with a completely different handle 30. Different handles contemplated by the inventor include a D-shaped handle wherein the locking pin 35 and actuator 31 are placed along the even portion of the handle 30. Alternate handle 30 designs contemplated by the inventor include those shaped like various animals and other objects that may serve to be appealing for an improved walking device.

Figure 5:
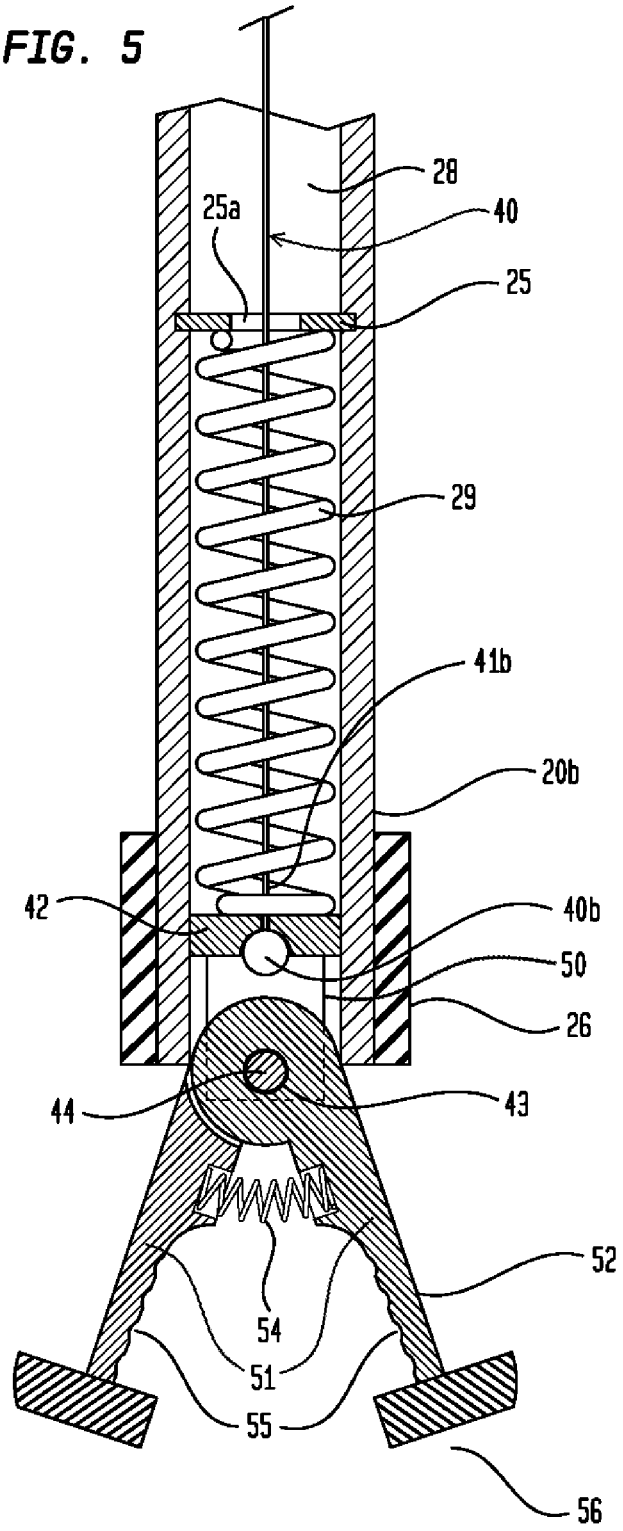
FIG. 5 is an internal view of the lower shaft and grasping member housing of the multi-functional walking device of FIG. 1 in the open configuration.
Figure 6:
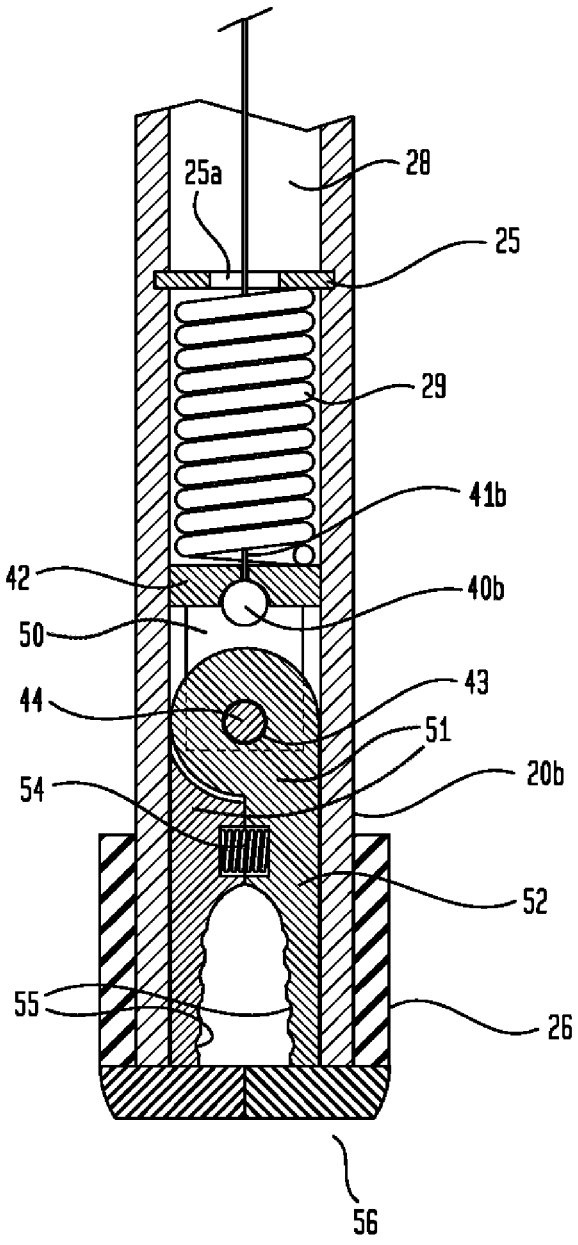
FIG. 6 is an internal view of the lower shaft and grasping member housing of the multi-functional walking device of FIG. 1 in the closed configuration.
Figure 7:
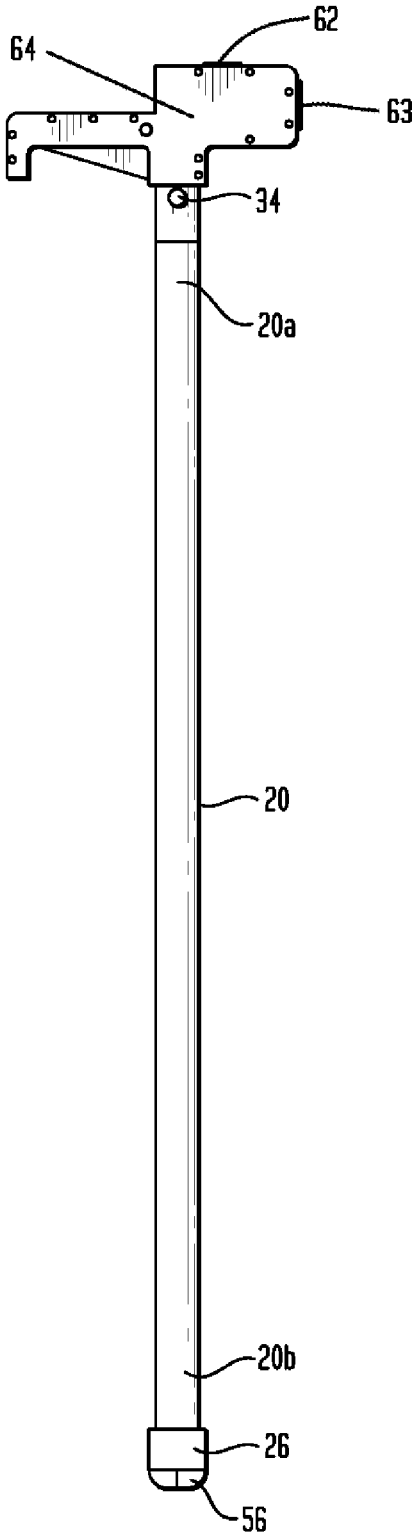
FIG. 7 is a perspective view of the multi-functional walking device including a recessed holder on the handle.
Figure 8:
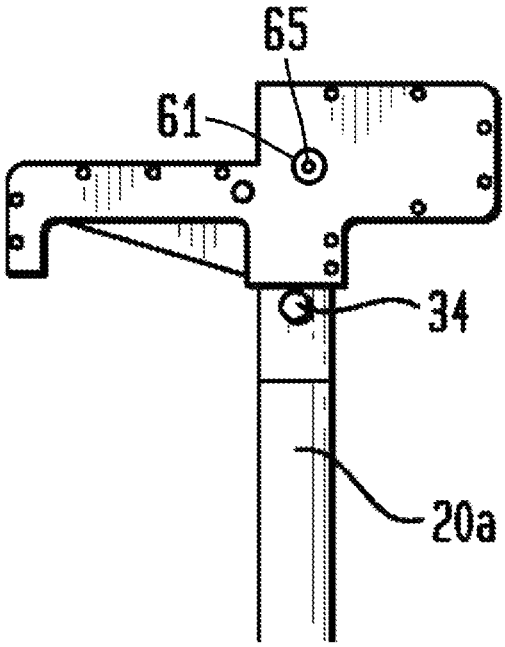
FIG. 8 is a perspective view of the multi-functional walking device including a lighting element on the handle.

Shown in FIGS. 5 and 6 are profile views of the lower half of the present invention in the open and closed configurations respectively. In FIGS. 5-6, the shaft 20 and cable 41 are shown as broken away to indicate that no particular length is being claimed. Also in FIGS. 5-6, the cable 41 connects through the shaft 20 to the actuator 31 as shown previously in FIGS. 3-4.

In both FIGS. 5-6, a cylindrical ferrule 26 fits concentrically around the cylindrical distal end 20*b* of the shaft. The ferrule 26 is then divided along the shaft surface to separate the cylindrical ferrule 26 from the circular ferrule 56. The circular ferrule 56 is divided along a longitudinal axis to create two semi-circular ferrules that are sized to fasten to the two semi-circular ends of the grasping members 51. The circular ferrule ends 56 provide protective functionality similar to a rubber ferrule on other cane and walking aid devices. The semi-circular ferrule ends 56 also help to reduce wear when grasping objects that may be prone to wear or scratches when grasped. Various materials contemplated for the ferrule component by the inventor include cellulosic material, plastics, and other materials that may be soft and also durable.

Immediately between the equatorial center of the shaft 20 to the distal end 20*b* is a stopping component 25 affixed internally and a tension spring 29 placed along the inner shaft 28 that prevents the linkage assembly 40 from being pulled upward beyond the stopping component 25. The stopping component 25 includes a center port 27 to thread a cable 41 toward the proximal end of the shaft 20*a* and the handle 30. Numerous materials are contemplated by the inventor for the shaft 20, including acrylic plastic, metals, wood, and other materials that can be hollowed and that can also support the weight of a human.

The grasping member housing 50 comprises the holder 42, a bolt 44, and the grasping members 51. The grasping members 51 comprise one or more conical components 52 with semi-circular ferrules 56 divided equally along a longitudinal axis designed to fit into the distal end of the shaft 20*b* when in the closed configuration and protrude outward when in the open configuration. In the ideal embodiment, the internal conical components 52 of the grasping members 51 are serrated 55 to improve grabbing functionality.

The holder 42 is shaped to fit into the inner shaft 28 below the stopping component 25 and tension spring 29, and includes an opening 43 at the distal end to receive the proximal ends of the grasping members 51. The holder 42 secures the grasping members 51 at the apex of the conical components 52 via a bolt 44 or other locking mechanism and a port 43 in the holder 42. The holder 42 also includes a means to couple the distal end of the cable 41 to the grasping members 51. Once the proximal end 41*a* of the cable is attached via the coupling and the distal end 41*b* of the cable is attached to the holder 42, a user can activate the improved grasping functionality of the present invention by placing the locking pin 35 in the open configuration and application of grasping force to the actuator 31. Between the grasping members 51 is an inner spring 54 that compresses when grasping objects.

When the device is in the closed configuration, the grasping members 51 are concealed and rest against one another inside the shaft 20 until placed into the open configuration. Once the device is placed into the open configuration, the grasping members 51 mechanically extend outward as far as allowed by the cable 41 and the bolt 44 from the distal end 20*b* of the shaft and away from one another so that they can be used to grasp one or more objects. As explained previously, once force is applied to the actuator 31, the grasping members 51 move inward toward the proximal end 20*a* of the shaft 20 and toward one another, creating the ability to grip one or more objects away from grabbing distance of the user.

In the open configuration, the grasping members 51 protrude outward from the distal end 20*b* of the shaft 20 as shown in FIG. 5. Because the pressure is released from the actuator 31, the cable 41 provides less tension and the grasping members 51 can protrude away from the distal end of the shaft 20*b*. The inner spring 54 and the tension spring 29 are both extended when the device is in the open configuration. When in the open configuration as shown in FIG. 5, the circular ferrule 56 is placed away from the cylindrical ferrule 26. As pressure is applied to the actuator 31, the grasping members 51 pull inward and the inner spring 54 and the tension spring 29 both begin to compress. As a result, a user can grip an object based on the force applied to the actuator 31. The serrated edges 55 can help hold an object between the grasping members 51 when used to help pick up one or more items.

In FIG. 6, as the cable 41 is pulled inward, the grasping member housing 50 is pulled inward into the shaft 20 as the tension spring 29 compresses toward the stopping point 25. In the closed configuration, the grasping members 51 are also pulled inwards into the shaft 20 until they reach the stopping point 25 via the opening 25*a* for the cable 41 along the inside of the shaft 20 as shown in FIG. 5. When in the closed configuration, the circular ferrule 56 is placed perpendicular to the cylindrical ferrule 26. The inner spring 54 and the tension spring 29 are both compressed when the device is in the closed configuration.

The inventor also contemplates using a D-shaped handle in place of the handle in the embodiment disclosed herein. While the mechanical assembly throughout the shaft 20 remains the same, as does the connecting functionality of the shaft to the handle 30, the actuator 31 and locking pin 35 are placed along the even surface of the D-shaped handle. The cable 41 can separate into two and connect to opposite ends of the actuator 31 via the coupling 31*a* at the ends of the proximal end of the cable 41*a* throughout the hollowed portion of the D-shaped handle assembly. When the locking pin 35 is in the open configuration and the user applies grasping force to the actuator 31, the actuator 31 pulls the cable 41 upward and activates the grasping functionality of the grasping members 51.

To relock the walking device into the closed configuration from the open configuration using the D-shaped handle, a user must initially engage the actuator 31 by applying upward pressure to fully retract the grasping members 51 and then move the locking pin 35 laterally toward the handle 30. Once into the closed configuration, the grasping members 51 will not mechanically protrude outward from the shaft 20 and will remain internal to the hollowed portion 28. The locking pin 35 will not move into the closed configuration unless the actuator 31 is fully engaged and the grasping members 51 are placed fully inside the shaft 20.

The inventor also contemplates adding additional functionality to the handle component to increase functionality along with improved grasping. The inventor contemplates addition of a compass 62 to the top or front of the handle for increased user awareness during navigation. If a user is in an unfamiliar location with a limited amount of time and a substantial distance to traverse, a compass 62 could assist the user with knowledge of cardinal directions and accuracy without carrying a separate component. Addition of a compass 62 to the handle of the invention disclosed herein would be useful improvement to a multi-functional walking device for individuals having walking difficulties.

The inventor also contemplates adding one or more lighting means 64 to the handle for improved user visual awareness during low-light activities. The lighting means 64 would comprise a light source 63 such as a diode, a battery, an activator, and a lighting circuit in a housing inside the front of the handle. The light source 63 would shine outward and external from the handle and be placed on the front of the handle behind the housing. It is contemplated that the lighting means 64 be ideally located on the top or on the laterals of the handle and a user would activate or deactivate the lighting circuit via the activator. Activators contemplated by the inventor used to activate the lighting functionality include buttons, switches, or sliding switches.

For quick attachment of the device to a portable holder on a belt or a backpack when not in use, the inventor also contemplates a recessed holder 61 along the surface and magnetic disc component 65 housed in the recessed holder 61 to magnetically receive another magnetic component along a a lanyard, loop, or carabiner that can be easily attached and detached from one another. The type of magnets contemplated by the inventor for use on the handle include strong rare earth magnets or weaker iron-based magnet discs that allow a user to quickly attach or detach the handle from a lanyard, loop, or carabiner attached to a belt or a backpack.

While a particular embodiment of the invention has been described and disclosed in the present application, it is clear that any number of permutations, modifications, or embodiments may be made without departing from the spirit and the scope of this invention. Accordingly, it is not the inventor's intention to limit this invention in this application, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise embodiment or form disclosed herein or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention under the claims.

In light of the above "Detailed Description," Inventor may make changes to the invention. While the detailed description outlines possible embodiments of the invention and discloses the best mode contemplated, no matter how detailed the above appears in text, the invention may be practiced in a myriad of ways. Thus, implementation details may vary considerably while still being encompassed by the spirit of the invention as disclosed by the inventor. As discussed herein, specific terminology used when describing certain features or aspects of the invention should not be taken to imply that the terminology is being redefined herein to be restricted to any specific characteristics, features, or aspects of the invention with which that terminology is associated.

I claim:

1. A retractable internally housed grasping assembly comprising:

a handle comprising a grabbing area, an actuator attached to the grabbing area and mounted thereto to move inward towards the handle portion from an open configuration to a closed configuration, internal threading, and a locking component;

a hollowed shaft comprising a body, a proximal end and a distal end, a stopping component with an opening placed concentrically within the shaft, tension spring, and openings at the proximal end and the distal end of the shaft, a linkage assembly placed internal to the shaft, the linkage assembly comprising a proximal end and a distal end, a cable with a proximal end and a distal end and ball-shaped elements at the proximal end and distal end of the cable, the proximal end of the linkage assembly being attached to the actuator via the ball-shaped element at the proximal end of the cable, the distal end of the linkage assembly being attached to a grasping member housing via the ball-shaped element of the distal end of the cable, the grasping member housing comprising a holder, a plurality of grasping members with proximal and distal ends, the distal ends of the grasping members arranged perpendicular to the body of the shaft and the bottom opening of the shaft;

wherein the locking component prevents the grasping members from protruding outward from the distal end of the shaft by securing the position of the actuator when the grasping members are inside the shaft;

wherein the linkage assembly being operably coupled to the grasping member housing and causing the grasping members to retract when applying physical force to the actuator; and wherein the locking component is configured so that the grasping members can be activated to protrude outward from the shaft or be concealed within the shaft.

2. A manually actuated multi-functional walking device with grasping functionality comprising:

a handle comprising a grabbing area, an actuator attached to the grabbing area and mounted thereto to move inward towards the handle portion from an open configuration to a closed configuration, internal threading, a tip, and a locking component;

a hollowed shaft comprising a body, a proximal end and a distal end, external threading on the proximal end of the shaft, a ferrule placed concentrically around an outer perimeter of the distal end of the shaft, a stopping component with an opening placed concentrically within the shaft, a tension spring, and openings at the proximal and distal ends of the shaft wherein the shaft is attached to the internal threading of the handle via the external threading;

a linkage assembly placed internal to the shaft, the linkage assembly comprising a proximal end and a distal end, a cable with a proximal end and a distal end and ball-shaped elements at the proximal end and distal end of the cable, the proximal end of the linkage assembly being attached to the actuator via the ball-shaped element at the proximal end of the cable, the distal end of the linkage assembly being attached to a grasping member housing via the ball-shaped element of the distal end of the cable, the grasping member housing comprising a holder, a plurality of grasping members with proximal and distal ends, and a ferrule at the distal ends of the grasping members internal to the shaft, the distal ends of the grasping members arranged perpendicular to the body of the shaft and the bottom opening of the shaft;

wherein the locking component prevents the grasping members from protruding outward from the distal end of the shaft by securing the position of the actuator when the grasping members are inside the shaft;

wherein the linkage assembly being operably coupled to the grasping member housing and causing the grasping members to retract when applying physical force to the actuator; and wherein the locking component is configured so that the grasping members can be activated to protrude outward from the shaft or concealed within the shaft.

3. The manually actuated multi-functional walking device with grasping functionality according to claim 2, wherein the handle further comprises a recessed holder and a magnetic disc component to fit in the recessed holder.

4. The manually actuated multi-functional walking device with grasping functionality according to claim 2, wherein the handle further comprises a compass along the tip of the handle.

5. The manually actuated multi-functional walking device with grasping functionality according to claim 2, wherein the handle further comprises a lighting means to activate or deactivate a lighting circuit via an activator.

6. The manually actuated multi-functional walking device with grasping functionality according to claim 2, wherein the handle can be interchanged based on the user's needs via the internal threading.

7. A manually actuated multi-functional walking device with grasping functionality comprising:

a handle comprising a grabbing area, an actuator attached to the grabbing area and mounted thereto to move inward towards the handle portion from an open configuration to a closed configuration, a compass, a recessed holder, a lighting means, internal threading, a tip, and a locking component;

a hollowed shaft comprising a body, a proximal end and a distal end, external threading on the proximal end of the shaft, a ferrule placed concentrically around an outer perimeter of the distal end of the shaft, a stopping component with an opening placed concentrically within the shaft, a tension spring, and openings at proximal and distal ends of the shaft wherein the shaft is attached to the internal threading of the handle via the external threading;

a linkage assembly placed internal to the shaft, the linkage assembly comprising a proximal end and a distal end, a cable with a proximal end and a distal end and ball-shaped elements at the proximal end and distal end of the cable, the proximal end of the linkage assembly being attached to the actuator via the ball-shaped element at the proximal end of the cable, the distal end of the linkage assembly being attached to a grasping member housing via the ball-shaped element of the distal end of the cable, the grasping member housing comprising a holder, a plurality of grasping members with proximal and distal ends, and a ferrule at the distal ends of the grasping members internal to the shaft, the distal ends of the grasping members arranged perpendicular to the body of the shaft and the bottom opening of the shaft;

wherein the locking component prevents the grasping members from protruding outward from the distal end of the shaft by securing the position of the actuator when the grasping members are inside the shaft;

wherein the linkage assembly being operably coupled to the grasping member housing and causing the grasping members to retract when applying physical force to the actuator; and wherein the locking component is configured so that the grasping members can be activated to protrude outward from the shaft or concealed within the shaft.

* * * * *